US007128123B2

(12) United States Patent
Mullet et al.

(10) Patent No.: US 7,128,123 B2
(45) Date of Patent: Oct. 31, 2006

(54) DOOR MOUNTING AND TRACK SYSTEM FOR A SECTIONAL DOOR

(75) Inventors: Willis J. Mullet, Gulf Breeze, FL (US); Gregory M. Rusnak, Milton, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 93 days.

(21) Appl. No.: 10/789,107

(22) Filed: Feb. 26, 2004

(65) Prior Publication Data

US 2005/0189079 A1 Sep. 1, 2005

(51) Int. Cl.
*E05D 15/24* (2006.01)

(52) U.S. Cl. ..... 160/209; 16/96 R

(58) Field of Classification Search ..... 160/201, 160/209; 16/96 R; 49/197
See application file for complete search history.

(56) References Cited

U.S. PATENT DOCUMENTS

| | | | | |
|---|---|---|---|---|
| 1,897,391 | A * | 2/1933 | Kelly | 160/189 |
| 1,990,870 | A * | 2/1935 | Kelly | 160/194 |
| 2,083,467 | A | 8/1937 | Morris | 20/20 |
| 2,966,212 | A | 12/1960 | Fimbel, Jr. | 160/193 |
| 4,119,133 | A * | 10/1978 | Wolf | 160/209 |
| 6,089,304 | A | 7/2000 | Mullet et al. | 160/209 |
| 6,640,872 | B1 * | 11/2003 | Mullet | 160/229.1 |
| 6,672,362 | B1 | 1/2004 | Mullet et al. | 160/201 |
| 6,745,814 | B1 * | 6/2004 | Hoofard et al. | 160/201 |

FOREIGN PATENT DOCUMENTS

| | | |
|---|---|---|
| CA | 2290432 | 3/1999 |
| WO | WO 90/03486 | 4/1990 |
| WO | WO 02/072992 A | 9/2002 |

* cited by examiner

*Primary Examiner*—Blair M. Johnson
(74) *Attorney, Agent, or Firm*—Renner Kenner Greive Bobak Talyor & Weber

(57) ABSTRACT

A door system including a sectional door having adjacent panels hinged for moving between a closed vertical position and an open horizontal position, the adjacent panels including at least a top panel, an intermediate panel, and a bottom panel, sets of lower rollers provided proximate the interfaces of the adjacent panels and proximate the lower extremity of the bottom panel, upper rollers carried proximate the upper extremity of the top panel, vertical track assemblies including vertical track sections and reverse angles, the reverse angles interconnecting with a header to form a door mounting system, transitional track members having first track sections and second track sections, and dual horizontal track assemblies having lower horizontal track sections and upper horizontal track sections, wherein the lower rollers are carried by the vertical track sections, the first track sections and the lower horizontal track sections and the upper rollers are carried by the second track sections and the upper horizontal track sections.

26 Claims, 5 Drawing Sheets

DOOR MOUNTING AND TRACK SYSTEM FOR A SECTIONAL DOOR

TECHNICAL FIELD

The present invention relates generally to a door mounting and track system for a movable barrier. More particularly, the present invention relates to a combination door mounting and track system for a movable barrier, such as a sectional door, which moves in and out of position relative to an opening. More specifically, the present invention relates to a combination door mounting and track system particularly suitable for circumstances where there is minimal clearance between a door frame and the overhead.

BACKGROUND ART

Using double or dual horizontal tracks in conjunction with sectional doors has been known to the industry for years. These dual horizontal tracks have been used to decrease the headroom required for operation of sectional doors. For example, one approach provides a sectional door having an upper panel, a top intermediate panel, a bottom intermediate panel, and a lower panel used in combination with dual horizontal tracks, and dual vertical tracks. The dual horizontal tracks include upper and lower horizontal track sections, and the vertical tracks include an inner vertical track section and an outer vertical track section. The lower horizontal track section and the inner vertical track section are interconnected by a curved transition track section to form a roller raceway.

Intermediate rollers provided on the intermediate panels are positioned within the above-discussed roller raceway to allow for articulation of the sectional door between opened and closed positions. Upper rollers are provided in the upper horizontal track section, and lower rollers are provided in the outer vertical track section. The upper horizontal track section and outer vertical track section include track extensions, and the upper rollers and lower rollers are respectively positioned therein when the sectional door is alternately closed and opened. That is, the upper rollers are positioned in the track extension attached to the upper horizontal track section when the sectional door is closed, and the lower rollers are positioned in the track extension attached to the outer vertical track section when the sectional door is opened. As such, the dual horizontal tracks, the dual vertical tracks, and track extensions allow the door panels to be substantially vertical when closed and substantially horizontal when opened, while simultaneously reducing the headroom required for operation.

However, the upper horizontal track section, the lower horizontal track section, the inner vertical track section and the outer vertical track section are separate components, and therefore, must be prepared before installation. To prepare for installation, the horizontal track sections must be joined together, and the vertical track sections must be joined together.

There are different methods for preparing these components for installation with a door. For example, the first method is to preassemble the horizontal track sections together and the vertical track sections together at the factory by mechanical means such as welding, button locking or fasteners. This first method requires labor and equipment for proper assembly, and such labor and equipment is an additional cost to the manufacturer.

A second method is to ship the components separately to the installer, and have the components assembled at the time of installation of the sectional door. This second method passes the costs associated with assembly to the installer, even though it is difficult to properly align the horizontal track sections and the vertical track sections in the field. Therefore, it is more likely for manufacturers to follow the first method of preparing the horizontal track sections and vertical track sections for installation.

Consequently, there is a need for dual track sections that do not require the additional costs of preassembly at the factory or in the field. These track sections should be capable of functioning in sectional door assemblies installed in locations where there is a minimum of space surrounding the frame of a door opening.

DISCLOSURE OF THE INVENTION

Therefore, an object of the present invention is to provide a door system including a combination door mounting and track system for sectional doors capable being installed in locations where there is a minimum of space surrounding the frame for a door opening. Another object of the present invention is to provide such a door system that may be adapted for use in areas having restricted overhead clearance above the door opening.

Another object of the present invention is to provide a door system incorporating a sectional door having adjacent articulating panels including at least a top panel, an intermediate panel, and a bottom panel. A further object of the present invention is to provide for the movement of the adjacent panels between a vertical closed position and a horizontal open position.

Another object of the present invention is to provide one piece vertical track assemblies incorporating vertical track sections and reverse angles, wherein preassembly of separate vertical track sections and reverse angles is not required. Still another object of the present invention is to provide reverse angles that can be attached to a header, wherein the header and reverse angles can be attached to the door frame.

A further object of the present invention is to provide reverse angles which effectively shield the vertical edges of the panels. A still further object of the present invention is to provide flag angles connecting the header with the reverse angles, wherein the flag angles are also configured to support transitional track members. A still further object of the present invention is to eliminate the need for a separate adaptor plate by attaching the operator directly to the header. Yet another objective of the present invention is to provide a door system, wherein the required overhead clearance is no higher than the top of the header and/or an operator attached thereto.

Another object of the present invention is to eliminate the need to preassemble separate horizontal track sections by providing one piece horizontal track sections. Still another object of the present invention is to interconnect the vertical track sections with the horizontal track sections using transitional track members. A further object of the present invention is to provide the transitional track members with first track sections and second track sections. A still further object of the present invention is to provide the first track sections with a curved shape extending through approximately ninety degrees. A still yet further object of the present invention is to provide the second track sections with a distal end positioned adjacent the header.

Another object of the present invention is to provide the dual horizontal track sections with lower horizontal track sections and upper horizontal track sections. A further object of the present invention is to provide a first roller raceway formed from the lower horizontal track sections interconnected with the vertical track sections via the first track sections. A still further object of the present invention is to provide a second roller raceway formed from the upper horizontal tracks interconnected with the second track sections.

In general, the present invention contemplates a door system including a sectional door having adjacent panels hinged for moving between a closed vertical position and an open horizontal position, the adjacent panels including at least a top panel, an intermediate panel, and a bottom panel, sets of lower rollers provided proximate the interfaces of the adjacent panels and proximate the lower extremity of the bottom panel, upper rollers carried proximate the upper extremity of the top panel, vertical track assemblies including vertical track sections and reverse angles, the reverse angles interconnecting with a header to form a door mounting system, transitional track members having first track sections and second track sections, and dual horizontal track assemblies having lower horizontal track sections and upper horizontal track sections, wherein the lower rollers are carried by the vertical track sections, the first track sections and the lower horizontal track sections and the upper rollers are carried by the second track sections and the upper horizontal track sections.

BEST MODE FOR CARRYING OUT THE INVENTION

Figure 1:
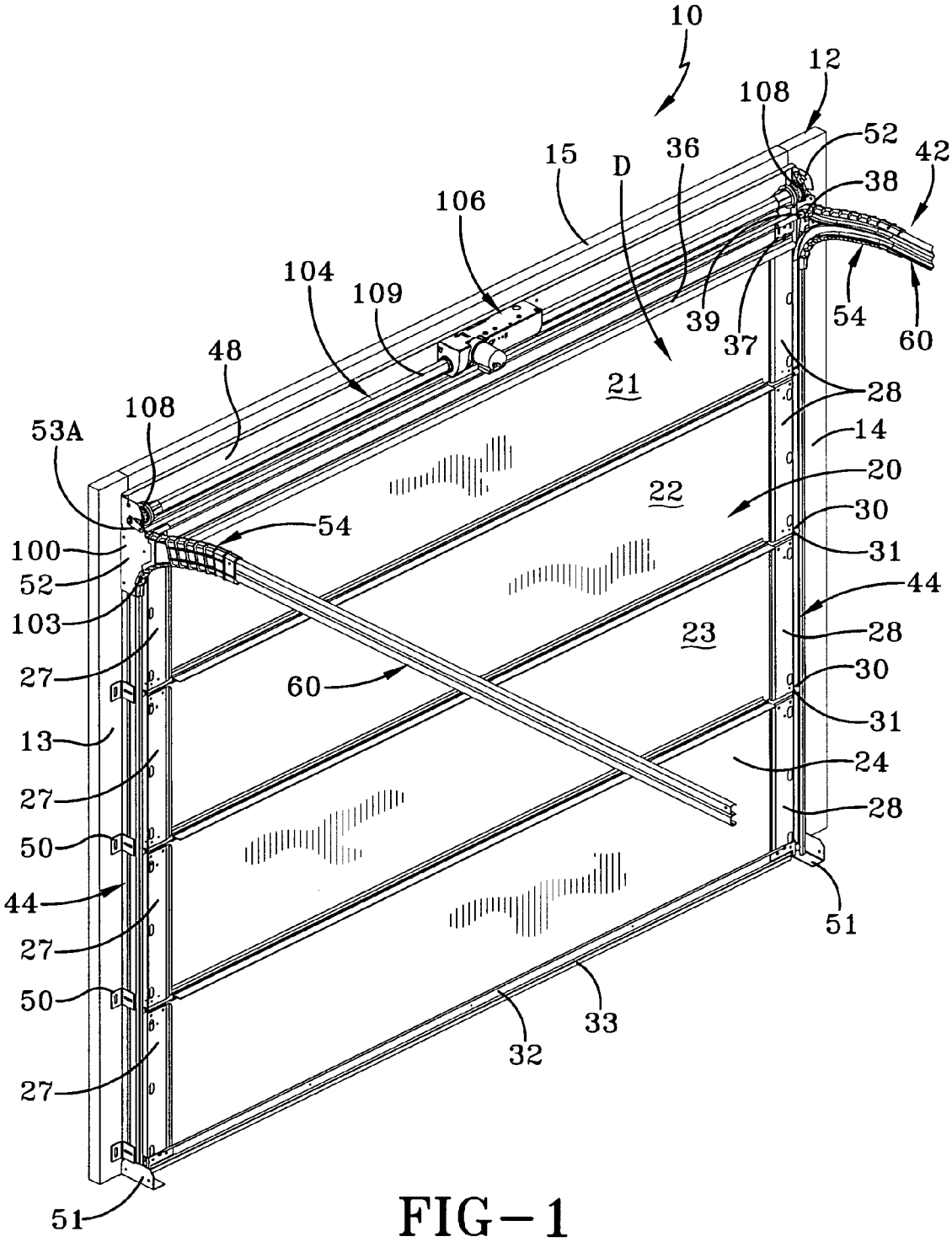
FIG. 1 is a fragmentary perspective view of a sectional door system embodying the concepts of the present invention.
Figure 2:
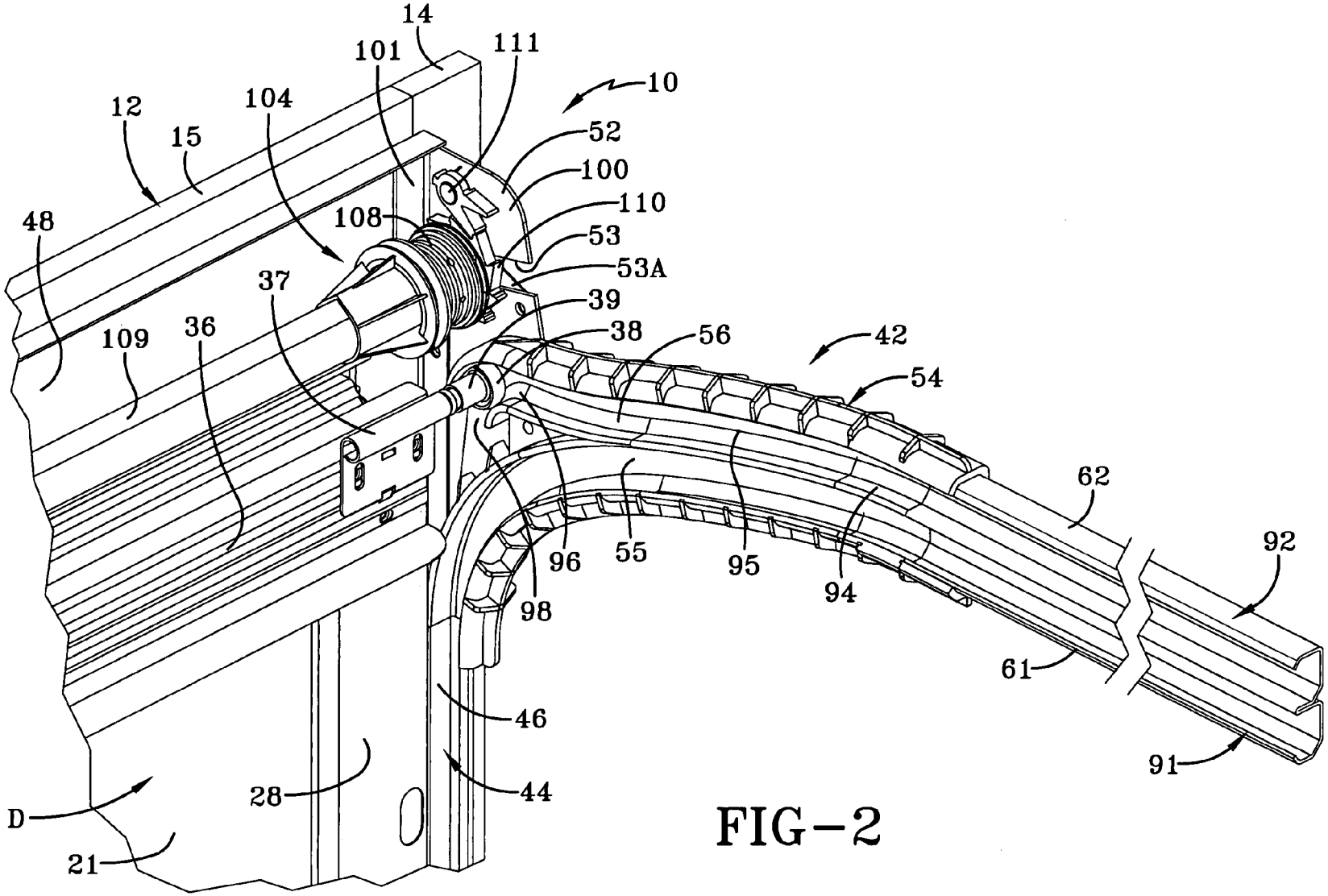
FIG. 2 is an enlarged fragmentary perspective view of a portion of the track system, door, counterbalance system, and header of the right side of the sectional door system depicted in FIG. 1.

A sectional door system according to concepts of the present invention is generally indicated by the numeral 10 in FIGS. 1 and 2 of the drawings. In part, the sectional door system 10 includes a door mounting system 11, and a conventional sectional door D of the type commonly employed in residential garages, utility buildings, and the like. The opening to which the sectional door D is positioned for opening and closing movements is surrounded by a door frame, generally indicated by the numeral 12. The door mounting system 11 may be attached to the door frame 12, and can be supplied to a construction site pre-assembled, as discussed hereinbelow.

Figure 6:
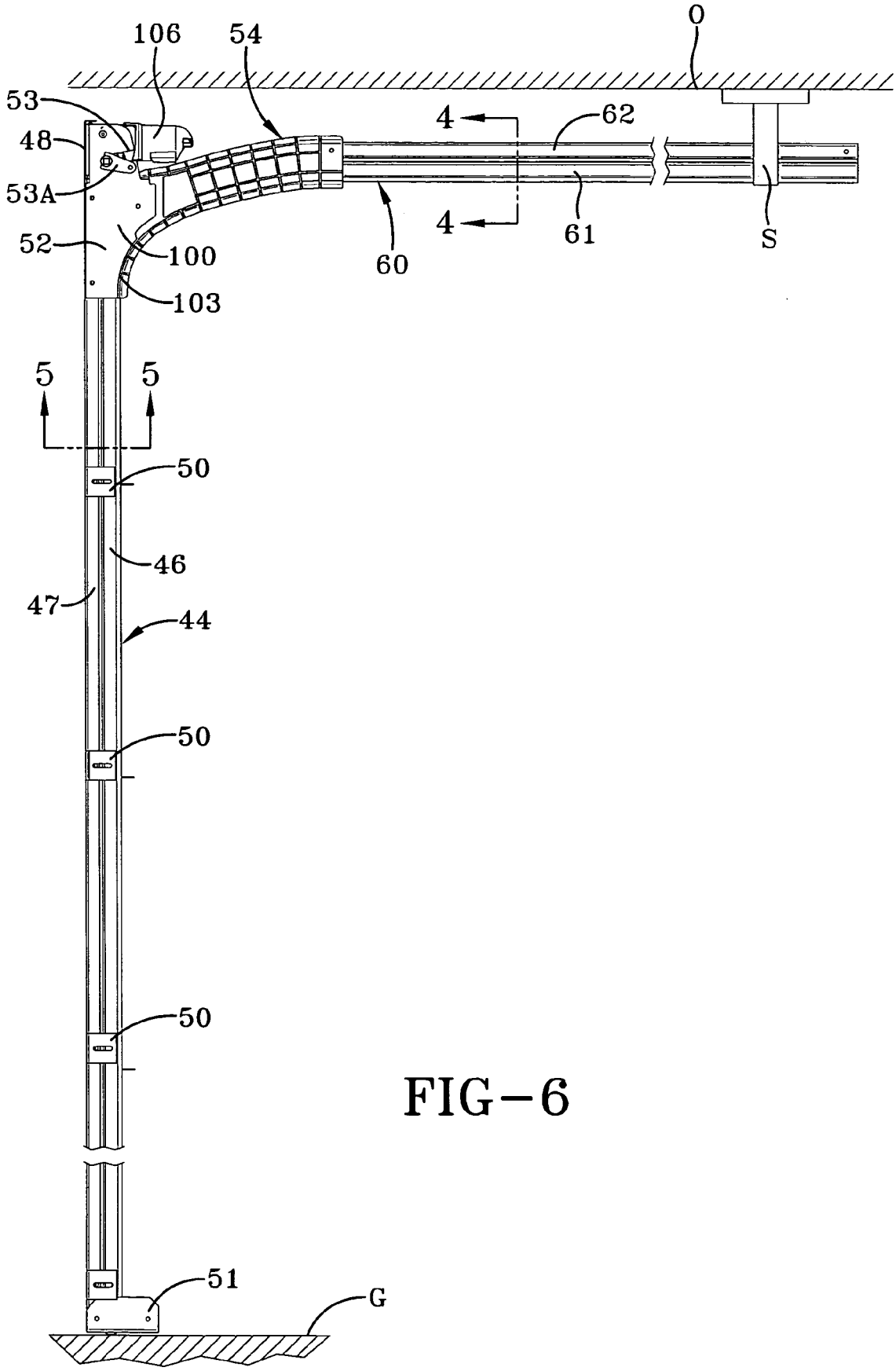
FIG. 6 is an enlarged fragmentary side elevational view of the sectional door system of FIG. 1, shown in a low overhead environment.

The door frame 12 consists of a pair of spaced framing members 13 and 14 that are generally parallel. The framing members 13 and 14 extend in a vertical direction upwardly from the garage floor or ground G (FIG. 6). The framing members 13 and 14 are spaced and joined at their vertical upper extremities by a cross member 15. The framing members 13 and 14, and the cross member 15 provide an inverted U-shape for the door frame 12 around the opening for attaching the door mounting system 11.

As seen in FIG. 1, the sectional door D consists of a rectangular arrangement of panels 20, including a top panel 21, an adjacent upper middle panel 22, an adjacent lower middle panel 23, and an adjacent bottom panel 24. While four panels are shown for exemplary purposes, it will be appreciated by persons skilled in the art that more or less panels may be employed depending upon the size of door frame 12 and other considerations. Each of the panels 21, 22, 23, 24 include a left-hand end stile 27 and a right-hand end stile 28. The left-hand end stiles 27 and right-hand end stiles 28 reinforce each of the panels 21, 22, 23, 24. As is known in the art, adjacent panels 21, 22, 23, 24 of the arrangement of panels 20 are hingedly connected to one another along their horizontal interfaces. To illustrate, the lower extremity of the upper middle panel 22 and the upper extremity of the lower middle panel 23 are hingedly connected to one another, and allow for articulation of the upper middle panel 22 and lower middle panel 23 with respect to each other during opening and closing of the sectional door D.

In addition to reinforcing the panels 21, 22, 23, 24, the left-hand end stiles 27 and right-hand end stiles 28 are adapted to carry lower rollers 30 and roller pins 31. Sets of the lower rollers 30 and roller pins 31 are carried by the lower vertical extremities of each of the left-hand end stiles 27 and right-hand end stiles 28, and are positioned near the interface of the adjacent panels 21, 22, 23, 24.

Figure 4:
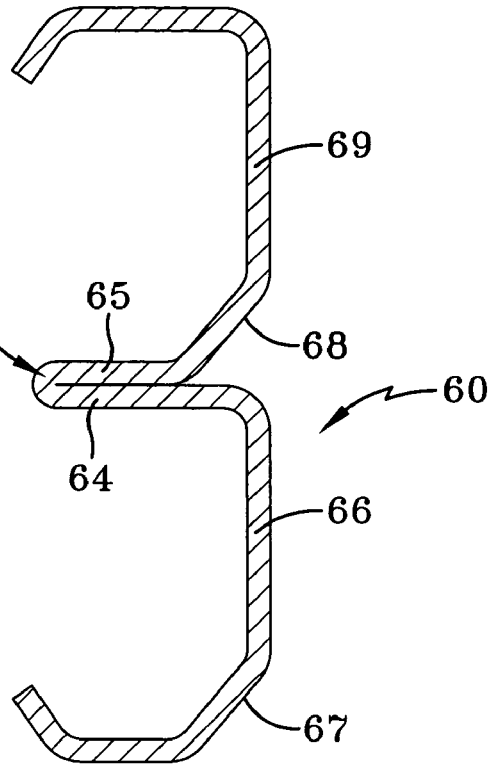
FIG. 4 is an enlarged cross-sectional view taken substantially along the line 4—4 of FIG. 6, showing the configuration of the dual horizontal track assembly of the sectional door system of FIG. 1.

Near the ground G, the lower extremity of the bottom panel 24 is equipped with a bottom panel extension 32 adapted to carry lower rollers 30 and roller pins 31. The bottom panel extension 32 can be equipped with weather stripping 33 to ensure a weather-tight seal between the sectional door D and the ground G. In a similar fashion to the bottom panel 24, the upper extremity of the top panel 21 is provided with a top panel extension 36. Roller brackets 37 are mounted on either side of the top panel extension 36, and are adapted to carry upper rollers 38 on roller pins 39 (FIG. 4).

Figure 3:
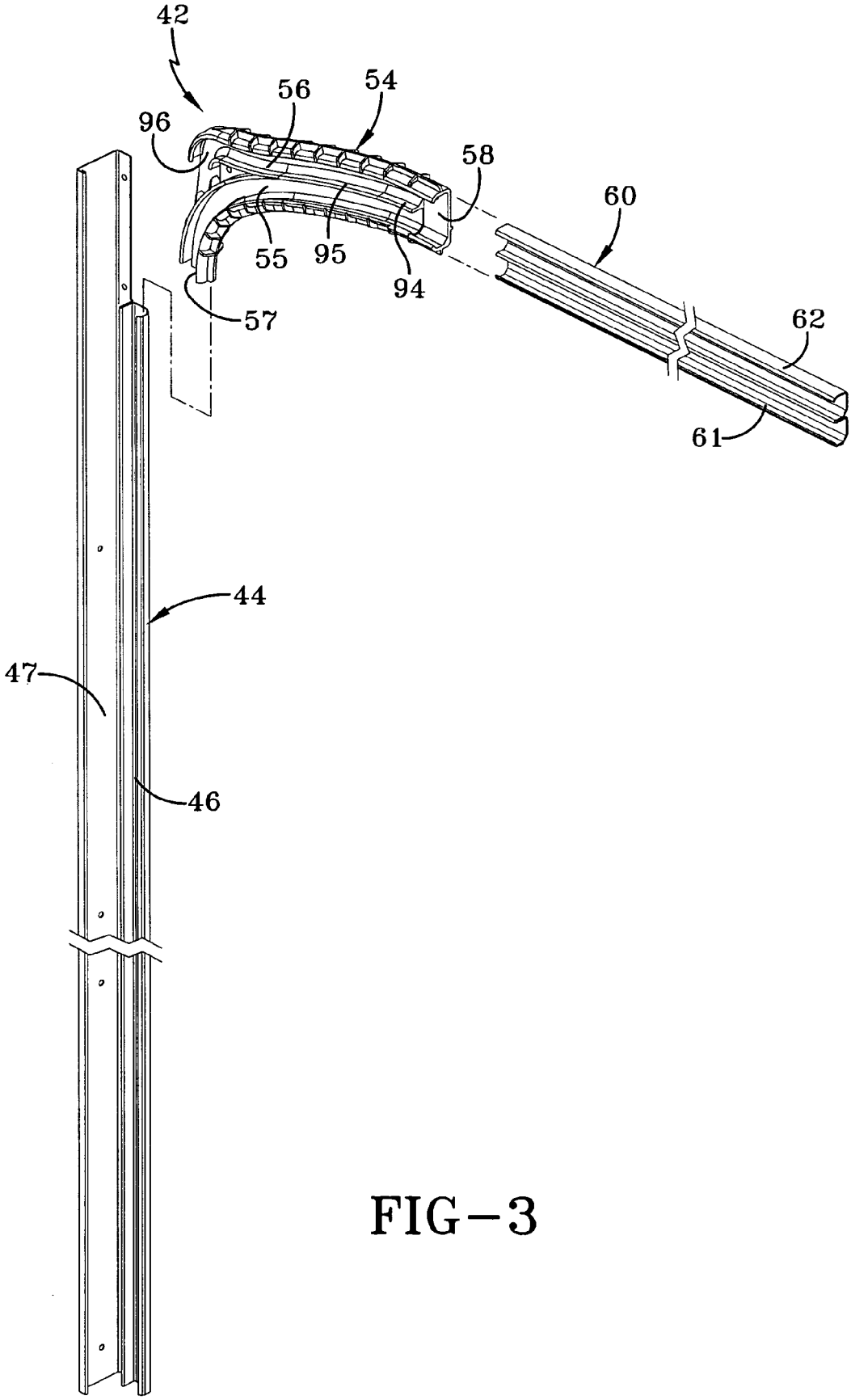
FIG. 3 is an exploded perspective view of the right side of the track system of the sectional door system of FIG. 1.

As seen in FIGS. 1–3, the sectional door D is moveably interrelated with the opening defined by the door frame 12 by a track system, generally indicated by the numeral 42. The door mounting system 11 is attached to the door frame 12, and shares components with the track system 42. For example, the track system 42 has vertical track assemblies, generally indicated by the numeral 44, positioned to either side of the sectional door D extending substantially vertically upward from the ground G.

Figure 5:
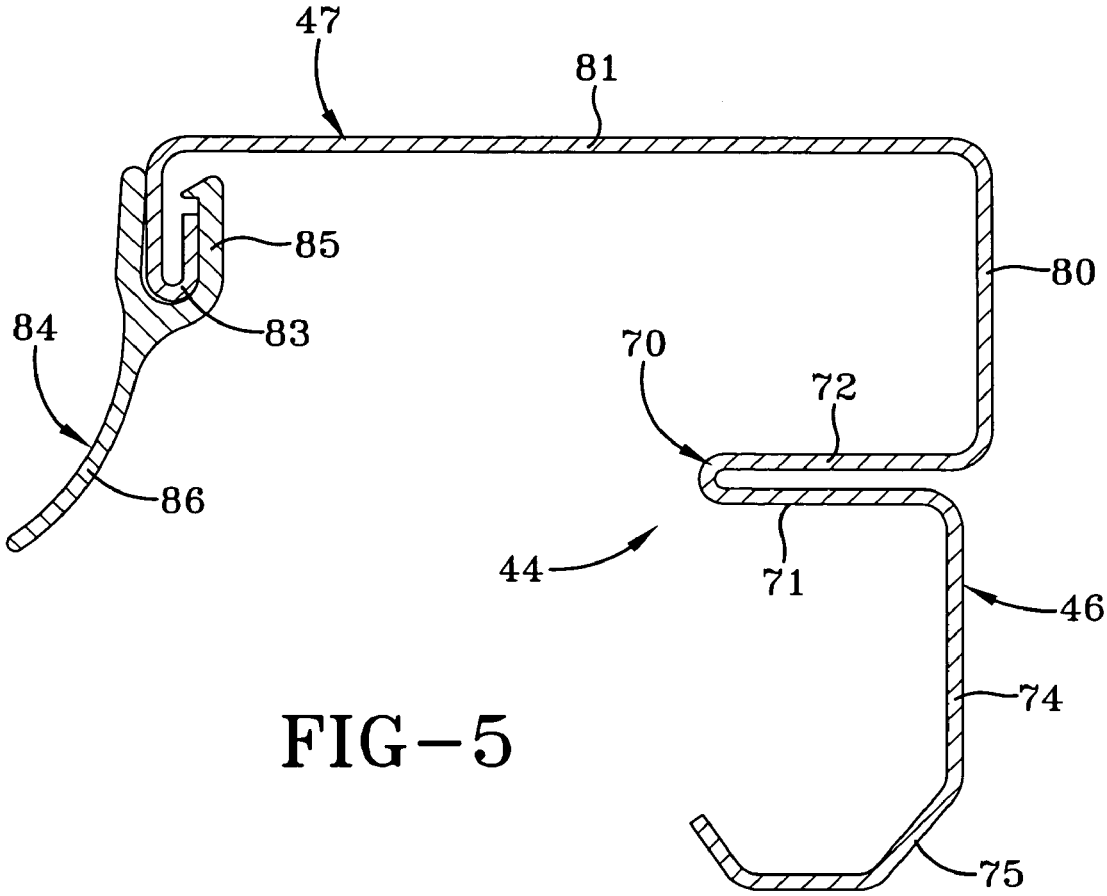
FIG. 5 is an enlarged cross-sectional view taken substantially along the line 5—5 of FIG. 6, showing the contour of a vertical track assembly, a reverse angle, and a door stop employed in the sectional door system of FIG. 1.

As best seen in FIGS. 3 and 5, the vertical track assemblies 44 include vertical track sections 46 and reverse angles 47. A portion of the reverse angles 47 serve as jamb members. As such, the reverse angles 47 are spaced and joined by a header 48, and are attached thereto by flag angles 52 as discussed hereinbelow. The flag angles 52 include notches 53 (FIG. 2), and interconnect the reverse angles 47 with the header 48 to form the door mounting system 11. The reverse angles 47 and the header 48 can be pre-assembled using the flag angles 52. Thereafter, the reverse angles 47 and the header 48 can be attached around the door frame 12. For example, the reverse angles 47 and header 48 can be lagged directly into the framing members 13 and 14 and cross member 15, respectively. The reverse angles 47 shield the vertical edges of panels 21, 22, 23, 24 and prevent those vertical edges from acting as potential pinch-points during operation of the sectional door D.

After the reverse angles 47 and the header 48 are positioned relative to the door frame 12, the track system 42 can be assembled. As seen in FIG. 1, when the track system 42 is assembled, the vertical track sections 46 are attached to the framing members 13 and 14 by jamb brackets 50. The jamb brackets 50 are vertically spaced along the vertical track sections 46 (FIGS. 1 and 6). Furthermore, the vertical track sections may be secured to the ground G using angle brackets 51.

The vertical track sections 46 are attached to transitional track members, generally indicated by the numeral 54. The transitional track members 54 include first track sections 55 and second track sections 56. The first track sections 55 are positioned below the second track sections 56, and the transitional track members 54 may be unitarily formed from cast, forged, or molded materials.

As seen in FIG. 2, the first track sections 55 and the second track sections 56 extend rearwardly to terminate with substantially horizontal orientations. Preferably, the first track sections 55 have a curved shape that extends through approximately ninety degrees from one end to the other. As discussed hereinbelow, the curved shape of the first track sections 55 is material to the decreased profile of door system 10. The decreased profile results in the vertical height of the track system 42 being substantially the same as the vertical height of the header 48. However, as necessary, the first track sections 55 can have alternate curvatures with either increased or decreased radii.

Referring particularly to FIG. 3, the transitional track members 54 include first receiving channels 57 and second receiving channels 58. The first receiving channels 57 are adapted to receive the vertical track sections 46. The second receiving channels 58 are adapted to receive dual horizontal track assemblies 60. The dual horizontal track assemblies 60 extend outwardly from the transitional track members 54 in a substantially horizontal direction. As seen in FIGS. 1–3, the dual horizontal track assemblies 60 are substantially perpendicular to the vertical track sections 46, and include lower horizontal track sections 61 and upper horizontal track sections 62. The dual horizontal track assemblies 60 are substantially vertically aligned with the header 48.

As shown, the dual horizontal track assemblies 60 are preferably integrally formed from one piece of material. More specifically, the horizontal track assemblies 60 can be formed from a shaped piece of sheet metal. In cross-section (FIG. 4), the horizontal track assemblies 60 are formed as a closed U-shaped central body, generally indicated by the numeral 63, having a first arm 64 and a second arm 65 of different lengths. The first arm 64 is longer than the second arm 65, and the first arm 64 is joined to an extension 66. The extension 66 is perpendicularly oriented relative to first arm 64. The extension 66 is joined to a lip 67, and the lip 67 is C-shaped to enclose or capture the lower rollers 30, thereby ultimately retaining the lower rollers 30 between the lip 67 and the first arm 64. The second arm 65 is joined to an angled extension 68, and, like the extension 66, the angled extension 68 is joined to a lip 69 which is inverted relative to lip 67. The lip 69 is J-shaped to enclose or capture the upper rollers 38, thereby ultimately retaining the upper rollers 38 between the lip 69 and the second arm 65.

Referring to FIG. 5, the vertical track assemblies 44 are also preferably integrally formed from one piece of material. More specifically, the vertical track sections 46 and the reverse angles 47 can be constructed from a formed piece of sheet metal. In cross section, the vertical track assemblies 44 include a U-shaped central body, generally indicated by the numeral 70. The U-shaped body 70 is formed by a first arm 71 and a second arm 72. The first arm 71 is joined to an extension 74, and the extension 74 is joined to a lip 75 to form the cross-sectional shape of the vertical track sections 46. As seen in FIG. 5, the lip 75 is C-shaped to enclose the lower rollers 30, thereby ultimately retaining the lower rollers 30 between the lip 75 and the first arm 71.

The second arm 72 is joined to an extension 80, and the extension is joined to a web 81 to form the cross-sectional shape of the reverse angles 47. To aid in the support of the track system 42, the web 81 is part of the door mounting system, and is joined to a framing member 13 or 14. Furthermore, the web 81 can be provided with a hook-shaped door stop 83. The door stop 83 extends generally perpendicularly inward from the web 81 and, when the sectional door D is closed, the door stop 83 is located directly adjacent the panels 21, 22, 23, 24. The door stop 83 is configured to prevent outward movement of panels 21, 22, 23, 24 when in the substantially vertical, closed orientation. Furthermore, the door stop 83 may readily mount a vertical extending flexible seal 84 to exert a positive pressure on the panels 21, 22, 23, 24. As such, the flexible seal 84 can also sealingly engage the panels 21, 22, 23, 24, and prevent environmental elements from infiltrating therebetween. In a known manner, the seal 84 preferably has a relatively rigid attachment portion 85 and a relatively flexible sealing lip 86 which may be made of PVC or other plastic.

As discussed hereinabove and as seen in FIGS. 2 and 3, the vertical track sections 46 and the dual horizontal track assemblies 60 are telescopically attached to the transitional track members 54. For example, the first receiving channels 57 couple and align the first track sections 55 with the vertical track sections 46. Furthermore, the second receiving channels 58 couple and align the first track sections 55 with the lower horizontal track sections 61, and couple and align the second track sections 56 with the upper horizontal track sections 62. This coupling and alignment provides smooth, quiet traverse of rollers 30, 38 through travel in the track system 42.

Through coupling using the transitional track members 54, the vertical track sections 46, the first track sections 55, and the lower horizontal track sections 61 form first roller raceways 91. The sets of lower rollers 30 attached to the panels 21, 22, 23, 24 travel within the first roller raceways 91. Furthermore, second roller raceways 92 are adapted to receive the upper rollers 38 and are formed from the interconnection of the second track sections 56 with the upper horizontal track sections 62. The first roller raceways 91 and the second roller raceways 92, and the respective movement of the lower rollers 30 and upper rollers 38 therein provides for the movement of the sectional door D between an open, substantially horizontal position and a closed, substantially vertical position. Thus, in cooperation with the lower rollers 30 and upper rollers 38, the first roller raceways 91 and second roller raceways 92, respectively, control the vertical movement, the horizontal movement, and the transition therebetween of the sectional door D.

The shape of the first track sections 55 that extends through approximately ninety degrees provides for the transition of the panels 21, 22, 23, 24 in the first roller raceways 91. Since the radius of curvature of the first track sections 55 is relatively small, the sectional door D can move between opened and closed position with minimal spacing between the opening in the door frame 12 and a low overhead O (see FIG. 6) in a garage or building. Moreover, the upper rollers 38 provided in the second roller raceways 92, and the shape of the second track sections 55 provide for the vertical alignment of the panels 21, 22, 23, 24, with the top panel 21 in the fully closed position when the door D is in the closed position (see FIGS. 1 and 2).

When the sectional door D is closing, i.e., moving from a substantially horizontal position to a substantially vertical position, the upper rollers 38 traveling in the second roller raceways 92 enter the second track sections 55 from the upper horizontal track sections 62. As seen in FIGS. 2 and 3, the second track sections 55 include substantially horizontal portions 94, curved portions 95, and elbow portions 96. When the sectional door D is closing, the upper rollers 38 enter the second track sections 55 at the horizontal portions 94, and thereafter transition downwardly in the vertical direction and outwardly in a horizontal direction using the curved portions 95. Nearing the end of their travel within the second raceways 92 and in second track sections 55, the upper rollers 38 enter the elbow portions 96 from the curved portions 95.

The elbow portions 96 curve abruptly downwardly and outwardly, and such abrupt change of direction facilitates the positioning of the top panel extension 36 and top panel 21 adjacent the header 48. Specifically, the top panel extension 36 and the top panel 21 articulate according to the movement of the upper rollers 38 in the second track sections 55. Furthermore, distal ends 98 of the elbow portions 96 are positioned directly adjacent the header 48, so that when the sectional door D is closed, the upper rollers 38 are seated in the distal ends 98. Therefore, when the sectional door D is closed, the top panel extension 36 and top panel 21 are located adjacent the header 48. Consequently, as seen in FIG. 1, the elbow sections 96, and the movement of the upper rollers 38 therein securely positions the top panel extension 36 and top panel 21 in vertical alignment with the remainder of the door panels 21, 22, 23, 24 such as to resist inward displacement of the top panel 21.

The elbow portions 96 maintain the top panel extension 36 and the top panel 21 in the seated position until sufficient opening forces produce an extent of vertical travel of the sectional door D, such that the upper rollers 38 can transcend the elbow portions 96 and then move into the curved portions 95, and the horizontal portions 94, and continue into the remainder of the second raceway 92.

The dual horizontal track assemblies 60 are supported proximate their rearward extremity by struts S which may be attached to the overhead O in a conventional fashion (FIG. 6). As discussed hereinabove, the dual horizontal track assemblies 60 are attached to the transitional track members 54. Furthermore, the flag angles 52 are attached to and support the transitional track members 54 (FIGS. 1 and 2). As such, the flag angles 52 effectively support the dual horizontal track assemblies 60 proximate their forward extremity.

The flag angles 52 have body portions 100, and tongue portions 101 extending outwardly in a perpendicular direction therefrom. The body portions 100 are configured to accept the reverse angles 47. Furthermore, the tongue portions 101 interface with the header 48. As such, the flag angles 52 interconnect the reverse angles 47 with the header 48 to form the door mounting system 11 as discussed hereinabove. The body portions 100 also accept the transitional track members 54 and may be curved at 103 to follow the contour of the transitional track members 54 to lower hang down below first roller raceways 91.

As seen in FIGS. 1 and 2, positioned between the flag angles 52 is a counterbalance system, generally indicated by the number 104. The counterbalance system 104 interrelates with an operator 106 attached to the header 48. As seen particularly in FIG. 6, the top of operator 106 is the limiting element in the head room required by door system 10, such that a low overhead O environment may be accommodated. As shown, the counterbalance system 104 includes cable drum mechanisms 108 and drive tube 109. The cable drum mechanisms 108 are positioned on the drive tube 109 proximate the ends thereof. The counterbalance system is supported by the flag angles 52 in the notches 53 and secured by retainer 53A. The cable drums 108 each have a suspension cable (not shown) reeved thereabout which is preferably affixed to the sectional door D proximate the lower extremity of the bottom panel 24. Actuation of the operator 106 provides for opening and closing movement of the sectional door D, and the counterbalance system 104 is configured to assist with opening and closing in a conventional fashion.

As seen best in FIGS. 1 and 2, the cable drum mechanisms 108 can be provided with gear wheel 110 attached to a driver for winding counterbalance system 104. The gear wheel 110 operatively interrelates with a pawl 111 attached to the body portion 80 of the flag angles 52. The pawl 111 is capable of engaging and disengaging the gear wheel 110 to maintain and permit adjustment of tension in the counterbalance system 104 in a manner known in the art.

Thus, it should be evident that the door mounting and track system for a sectional door disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

The invention claimed is:

1. A door system for use with an opening defined by a pair of vertically oriented framing members and joined by a horizontally oriented cross member, the door system comprising, a sectional door having adjacent panels hinged for moving between a closed vertical position and an open horizontal position, said adjacent panels including at least a top panel, an intermediate panel, and a bottom panel, sets of lower rollers provided proximate the interfaces of said adjacent panels and proximate the lower extremity of said bottom panel, upper rollers carried proximate the upper extremity of said top panel, said top panel including a top panel extension, and said upper rollers positioned on said top panel extension, vertical track assemblies including vertical track sections and reverse angles, a header spacing said vertical track assemblies and flag angles interconnecting said reverse angles with said header to form a door mounting system, transitional track members having first track sections and second track sections, and dual horizontal track assemblies having lower horizontal track sections and upper horizontal track sections, wherein said lower rollers are carried by said vertical track sections, said first track sections, and said lower horizontal track sections, and said upper rollers are carried by said second track sections and said upper horizontal track sections and wherein said header, said flag angle and said vertical track assemblies of said door mounting system may be preassembled and coupled to the framing members and the cross member.

2. A door system according to claim 1, wherein said vertical track sections, said transitional track members, and said dual horizontal track assemblies form a track system, said track system having a first roller raceway adapted to carry said lower rollers and a second roller raceway adapted to carry said upper rollers.

3. A door system according to claim 2, wherein said first roller raceway is formed by interconnecting said lower horizontal track sections with said first track sections, said first track sections transitioning said first roller raceway through approximately ninety degrees into said vertical track assemblies, and wherein said second roller raceway is formed by interconnecting said upper horizontal track sections with said second track sections, said first roller raceway and said second roller raceway providing for movement of said sectional door between said closed vertical position and said open horizontal position.

4. A door system according to claim 1, wherein said transitional track members include first receiving channels adapted to receive said vertical track sections and second receiving channels adapted to receive said dual horizontal track assemblies, said first track section being connected with said lower horizontal track section and said second track section being connected with said upper horizontal track section.

5. A door system according to claim 4, wherein said first track sections transition through approximately ninety degrees to interconnect said lower horizontal track sections with said vertical track sections.

6. A door system according to claim 4, wherein said second track sections include elbow sections having distal ends positioned substantially adjacent said header, said distal ends configured to carry said upper rollers, thereby vertically aligning said top panel with the remainder of said panels, when said sectional door is in said closed vertical position.

7. A door system according to claim 6, wherein said second track sections further include horizontal portions and curved portions, said top panel articulating according to the movement of said upper rollers through said horizontal portions, said curved portions, and said elbow portions.

8. A door system according to claim 1, wherein said flag angles support said transitional track members, said transitional track members interconnecting said vertical track sections and said dual horizontal track assemblies.

9. A door system according to claim 1 further comprising, a counterbalance system connected to said sectional door and mounted on said flag angles.

10. A door system according to claim 1, wherein said vertical track assemblies include an extension and a web, said extension and said web spacing a door stop from said vertical track sections, thereby allowing said door stop to prevent outward movement of said panels when said sectional door is in said closed vertical position.

11. A door system according to claim 10, wherein said door stop is adapted to carry a flexible seal, said flexible seal exerting pressure on said panels when said sectional door is in said closed vertical position to prevent environmental elements from infiltrating therebetween.

12. A door system according to claim 1, wherein said vertical track assemblies are of one-piece construction.

13. A door system according to claim 1, wherein said dual horizontal track assemblies are of one-piece construction.

14. A door system according to claim 1 further comprising, an operator for moving said sectional door directly mounted on said header.

15. A door system according to claim 1, wherein said transition track members are cast of either of metallic and non-metallic material.

16. A door system for use with an opening defined by a pair of vertically oriented framing members and joined by a horizontally oriented cross member, the door system comprising, a sectional door having hinged panels for moving between a closed vertical position and an open horizontal position, rollers mounted on said panels, and a track system directing travel of said rollers when moving said door between said closed vertical position and said open horizontal position and having horizontal track assemblies, transitional track assemblies and vertical track assemblies which include a track section adapted to receive at least one of said rollers, a web adapted to mount to said vertically oriented framing members, and an extension which joins said web to said track section and outwardly spaces said track section from said vertically oriented framing members, wherein said web, said track section and said extension are comprised of a single uninterrupted member, and said extensions and said track sections are jointed by a U-shaped central body portion.

17. The door system of claim 16 further comprising, a header spacing and joining said vertical track assemblies.

18. The door system of claim 17, wherein a portion of said webs constitute jambs which are connected to said header to permit preassembly thereof.

19. A door system of claim 16, wherein each said vertical track assembly further includes a stop member adapted to prevent outward movement of said panels when said door is in said closed vertical position.

20. A door system comprising, a sectional door having hinged panels for moving between a closed vertical position and an open horizontal position, rollers mounted on said panels and a track system directing travel of said rollers when moving said door between said closed vertical position and said open horizontal position and having vertical track assemblies having track sections and reverse angles formed of a single uninterrupted member, transitional track members having first track sections and second track sections formed of a single uninterrupted member and horizontal track assemblies having upper horizontal track sections and lower horizontal track sections formed of a single uninterrupted member and joined by a closed U-shaped central body portion, wherein said transitional track members include first receiving channels adapted to telescopically receive said vertical track sections and second receiving channels adapted to telescopically receive said dual horizontal track assemblies, said first track section being connected with said lower horizontal track section and said second track section being connected with said upper horizontal track section.

21. The door system of claim 20, wherein said upper horizontal track sections have first lips for retaining said rollers and said lower horizontal track sections have second lips for retaining said rollers.

22. The door system of claim 21, wherein said second lips are inverted relative to said first lips.

23. A door system of claim 20 further comprising, means for supporting said track system.

24. A door system of claim 23, wherein said means for supporting said track system includes flag angles.

25. A door system of claim 20, wherein said transitional track members are cast of either of metallic and non-metallic material.

26. A door system according to claim 20, wherein said transition track members are cast of either of metallic and non-metallic material.

* * * * *